US005344530A

United States Patent [19]

de Nora et al.

[11] Patent Number: 5,344,530

[45] Date of Patent: Sep. 6, 1994

[54] METAL ANODES FOR ELECTROLYTIC ACID SOLUTIONS CONTAINING FLUORIDES OR FLUOROANIONIC COMPLEXES

[75] Inventors: Oronzio de Nora; Antonio Nidola; Carlo Traini; Ulderico Nevosi, all of Milan, Italy

[73] Assignee: De Nora Permelec S.p.A., Italy

[21] Appl. No.: 55,210

[22] Filed: Apr. 29, 1993

Related U.S. Application Data

[62] Division of Ser. No. 841,375, Feb. 25, 1992, abandoned.

[30] Foreign Application Priority Data

Mar. 1, 1991 [IT] Italy ..... 91-00055

[51] Int. Cl.[5] ..... C25C 1/00; C25C 1/10; C25C 1/14; C25C 1/18

[52] U.S. Cl. ..... 204/105 R; 204/115; 204/120; 204/291; 204/290 R

[58] Field of Search ..... 204/105 R, 114, 115, 204/290 R, 291; C25C 1/00, 1/10, 1/14, 1/18

[56] References Cited

U.S. PATENT DOCUMENTS

| | | | |
|---|---|---|---|
| 3,985,630 | 10/1976 | Ginatta | 204/96 |
| 4,135,997 | 1/1979 | Stauter | 204/117 |
| 4,230,545 | 10/1980 | Prengaman et al. | 204/114 |
| 4,272,340 | 6/1981 | Cole, Jr. et al. | 204/114 |
| 4,460,442 | 7/1984 | Ducati | 204/114 |
| 4,826,579 | 5/1989 | Westfall | 204/45.1 |
| 4,834,851 | 5/1989 | Nidola et al. | 204/114 |
| 5,215,631 | 6/1993 | Westfall | 204/64 |

*Primary Examiner*—Kathryn Gorgos
*Attorney, Agent, or Firm*—Bierman and Muserlian

[57] ABSTRACT

The present invention relates to metal anodes for oxygen evolution from solutions containing fluorides or artionic fluorocomplexes such as tetrafluoroborates and hexafluorosilicates, the anodes having a metal substrate or matrix selected in the group comprising nickel-copper alloys with a copper content in the range of 2.5 and 30% by weight, tungsten or tantalum, niobium or titanium, combinations thereof or alloys of the same with palladium, nickel or yttrium. The anodes further comprise electrocatalytic compounds for oxygen evolution dispersed in the metal matrix. In the case of nickel-copper alloys, useful electrocatalytic compounds are cerium or tin dioxides, with suitable additives, while for tungsten, cobalt added with nickel, iron, copper or palladium may be used. The same electrocatalytic compounds may be advantageously applied to said metal substrate or matrix in the form of a coating using the conventional technique of thermal decomposition of paints containing suitable precursors or by thermal deposition such as plasma-spray.

8 Claims, No Drawings

METAL ANODES FOR ELECTROLYTIC ACID SOLUTIONS CONTAINING FLUORIDES OR FLUOROANIONIC COMPLEXES

PRIOR APPLICATION

This application is a division of U.S. patent application Ser. No. 841,375 filed Feb. 25, 1992, now abandoned.

Electrolytes containing anionic fluorocomplexes are commonly used in conventional technologies for the electrolytic recovery of metals, such as lead, tin, chromium. In the specific case of lead recovery from batteries scraps, the scraps are leached with acid solutions containing tetrafluoroborates $BF_4-$ and hexafluorosilicates $SiF_6=$. The electrolysis of these solutions produces lead as a solid deposit; therefore, the electrolytic cells are diaphragmless and have a very simple design. However, this advantage has been so far counterbalanced by the scarce resistance of the substrates to the aggressive action of anionic fluorocomplexes on the anodes whereat oxygen is evolved. Further, a parasitic reaction may take place with formation of lead dioxide which subtracts lead to the galvanic deposition of the metal; thus, reducing the overall efficiency of the system.

Upon carefully considering the prior art teachings found for example in U.S. Pat. Nos. 3,985,630, 4,135,997, 4,230,545, 4,272,340, 4,460,442, 4,834,851 and in Italian patent application no. 67723A/82, it may be concluded that:

anodes made of carbon or graphite, as such or coated by lead dioxide, are known in the art but offer a rather limited active lifetime, in the range of a hundred hours due to the oxidizing action of oxygen evolution. Obviously, this brings forth higher maintenance costs for substituting the anodes and additional costs connected to the consequent production losses;

anodes made of titanium, coated by lead dioxide or platinum or oxides of the platinum group metals, still undergo corrosion, though to a far less extent with respect to carbon or graphite, in any case, insufficient for counterbalancing the higher construction costs;

anodes made of tantalum coated by platinum metal or metal oxides offer a much longer lifetime than titanium but the production costs are extremely high;

the parasitic reaction of lead dioxide deposition onto any type of anode may be prevented adding a suitable inhibitor to the leaching solution; for example phosphoric acid, antimony acid or arsenic acid. However, the quantities required may spoil the compactness of the lead metal deposit. This problem is overcome by resorting to an anode having a coating made of metals or oxides of the platinum group metals and at least one element comprised in the group of arsenic, antimony, bismuth, tin. In this case, a remarkably lower quantity of inhibitor to prevent the anodic deposition of lead dioxide is required, and the deterioration of the produced lead deposit is eliminated. It is, therefore, evident that the prior art does not provide for an anode offering both a long lifetime (higher than 1000 hours) and a limited cost, which are both necessary features for wide industrial application.

THE INVENTION

The present invention permits to overcome the disadvantages of the prior art by providing for an anode characterized by a reduced cost, high resistance to the aggressive conditions of oxygen evolution in solutions containing anionic fluorocomplexes and even free fluorides, and good catalytic properties for oxygen evolution; that is lower electrolysis potential with consequently reduced energy consumptions.

The anode of the present invention comprises a matrix made of one or more metals or metal alloys capable of passivating by forming a protective layer of oxides or oxyfluorides and one or more compounds of suitable elements capable of flavoring oxygen evolution; said elements being embedded into the matrix or alternatively applied to the same in the form of an external coating. Said anode is suitable for use in electrometallurgical processes for the deposition of lead, tin, chromium, from solutions containing fluorocomplex anions such as tetrafluoroborates and hexafluorosilicates or free fluorides.

The present invention also comprises the electrolytic process for recovering metals in cells equipped with anodes and cathodes and fed with acid solutions containing metal ions and anionic fluorocomplexes such as tetrafluoroborates and hexafluorosilicates, wherein said anodes are of above mentioned type.

The following description will take into consideration the particular case of electrolytic recovery of lead, for simplicity sake. In this process, the leaching solution to be electrolyzed has the following composition:

tetrafluoroboric acid, $HBF_4$, or hexafluorosilic acid $H_2SiF_6$: 40–240 g/l;
dissolved lead: 40–80 g/l;
temperature: 15°–35° C.;
current density (anodic and cathodic): 150–2000 $A/m^2$.

Electrolysis occurs between the anode and the cathode, with the following reactions:

cathode: $Pb^{++}$ (complex)$+2e^- \rightarrow Pb$ (compact metal)
anode: $H_{20}O-2e^- \rightarrow 2H^+ + 1/12O_2$ (main reaction)
$Pb^{++}$ (complex)$+2H_2O-2e^- \rightarrow PbO_2+4H^+$ (parasitic reaction)

Suitable elements for the anode are : titanium, niobium, tantalum, tungsten or alloys thereof such as:

titanium-palladium (Pd 0.2%),
titanium-nickel (Ni 0.5–1.5%);
titanium-yttrium
titanium-tantalum ( Ta 0.5–5.0%)
titanium-niobium (Nb 0.5–5.0%)
titanium-tungsten (W 0.5–5.0%)
copper-tantalum (niobium);
titanium-tantalum (niobium)

Further, it has been surprisingly found that alloys of nickel-copper, obtained either by sinterization of the powders of the elements or by melting and casting in suitable molds readily passivate when put in contact with the aforementioned solutions; that is they become coated by a protective layer of oxides or oxyfluorides or insoluble fluorides when the copper content is in the range of 2.5 to 30% and more preferably between 5 and 20%.

The poor conductivity of the protective film formed on the above metals gives rise to a high potential, and consequently, to high energy consumptions in the process of lead recovery.

It has been found that when using tungsten and nickel-copper alloys, if suitable elements are dispersed into the metal matrix, the oxygen evolution potential is remarkably reduced, bringing the energy consumption to quite acceptable levels for industrial applications for the production of lead.

Suitable compounds for anodes based on nickel-copper are cerium oxide, $CeO_2$, added with $Nb_2O_5$ (1–5%), NiO (0.5–2%), $Pr_6O_{11}$ (0.5–2%), CuO (0.5–2%) and tin dioxide, $SnO_2$, added with $Sb_2O_3$ (0.5–4%) and CuO (0.5–2%); while for anodes based on tungsten, addition of cobalt (5–35%) optionally mixed with minor amounts of iron and nickel (1–2%), copper, palladium and cerium result more positive.

The same results are alternatively obtained by applying to the metal matrix a coating exhibiting electrocatalytic properties for oxygen evolution, chemical stability and possibly limited porosity to ensure an adequate protection to the metal matrix.

In the case of tungsten and nickel-copper alloys, suitable coatings are obtained by cerium and tin oxides as above described for the dispersion in the metal matrix. As for the other alloys, testing has shown that a suitable coating must comprise a matrix made of tungsten or other metal of the VIB group (70–99%), cobalt (1–30%) as the electrocatalyst for oxygen evolution to inhibit possible parasitic reactions and further comprising suitable additives selected from the group comprising nickel, palladium, cerium and copper, or optionally, a combination of the same, (0.5–2%).

The following examples describe various embodiments of the present invention without limiting the invention to the same.

EXAMPLE 1

Eight rods having a diameter of 20 mm, 100 mm long, made of nickel-copper alloys, having different compositions, have been prepared by monostatic lateral pressing (about 250 kg/cm$^2$) starting from the powders of the elements (1–10 microns) and subjected to subsequent thermal treatment in inert environment at 950°–1150° C. for 6–12 hours (preferably between 980°and 1080° C. for 8–10 hours) followed by a second oxidizing treatment in air at 900°–1300° C. for 100–600 hours (preferably 970°–1000° C., 300–400 hours for copper contents higher than 10–15%).

At the same time, three reference samples have been prepared as follows:

two rods having a diameter of 20 mm, 100 mm long, based on commercial Monel®, (nickel, copper alloy) one of the 400 type and the other of the K500 type oxidized at the conditions used for the samples obtained by sinterization one sheet of 10×100×1 mm made of commercial graphite coated by a deposit of beta-$PbO_2$ obtained by galvanic deposition from nitrate bath. The sintered rods and the reference samples have been tested as anodes in the electrolysis of a fluoroboric solution, which is the typical electrolyte used for metal lead recovery from batteries scraps.

The operating conditions and the results are reported in the following Table.

| OPERATING CONDITIONS | |
|---|---|
| HBF4, tetrafluoroboric acid: | 80 g/l |
| Temperature: | Ambient |
| Cathode: | Lead |
| Procedure: | Determination of the corrosion potential (PC) by electrochemical potentiostatic procedure and analysis of the solution and cathodic deposit; comparison with the oxygen evolution potential (PO) detected on a graphite electrode coated by beta-$PbO_2$. The value Delta V = PC − PO defines the stability or instability degree of the various materials. |

TABLE 1.2

| SAMPLES No. | | RESULTS: Anodic Potential V (NHE) Corrosion PC Volts | $O_2$ Evolution PO Volts 400 A/m$^2$ | $O_2$ Evolution PO Volts 1000 A/m$^2$ | Delta V PC-PO (Volts) 400 A/m$^2$ | Delta V PC-PO (Volts) 1000 A/m$^2$ | |
|---|---|---|---|---|---|---|---|
| 1 | Beta-$Pb_2$ on graphite | | 2.07 | 2.24 | | | |
| 2 | Monel 400 type | +0.38 | | | −1.69 | | 1.86 corroded |
| 3 | Monel K500 type | +0.39 | | | −1.68 | −1.86 | 1.86 corroded |
| 4 | Ni 99-Cu 1 | −0.1 | | | −2.17 | −2.34 | 1.86 corroded |
| 5 | Ni 98-Cu 2 | +0.36 | | | −1.71 | −1.88 | 1.86 corroded |
| 6 | Ni 97.5-Cu 2.5 | +1.30 | | | −0.77 | −0.94 | 1.86 corroded |
| 7 | Ni 95-Cu 5 | >2.3 | | | >0.23 | >0.06 | 1.86 passivated |
| 8 | Ni 90-Cu 10 | >2.3 | | | >0.23 | >0.06 | 1.86 passivated |
| 9 | Ni 80 Cu 20 | >2.3 | | | >0.23 | >0.06 | 1.86 passivated |
| 10 | Ni 70 Cu 30 | +0.99 | | | −1.08 | −1.25 | 1.86 corroded |
| 11 | Ni 65-Cu 35 | +0.43 | | | −1.65 | −1.81 | 1.86 corroded |

The above results lead to the following considerations:

oxygen evolution on beta-$PbO_2$ occurs at potentials (PO) comprised between 2.07 and 2.24 Volts at current densities between 400–1000 A/m$^2$. It is evident that any material having a Corrosion Potential (PC) lower than these values is characterized by instability (tendency to dissolve). The various potentials refer to a reference normal hydrogen electrode (NHE);

the materials with a copper content between 5 and 20% are stable under oxygen evolution.

Similar materials obtained not by sinterization but by molding with casting wax showed the same behaviour.

EXAMPLE 2

Twelve rods having a diameter of 20 mm, 100 mm long, made of sintered nickel-copper alloys have been prepared as described in Example 1, the only difference being the addition of preformed powders (pigments) based on tin oxide and cerium oxide. The electrolysis conditions and the results expressed in terms of anodic potentials, V(NHE) for oxygen evolution at 1000 A/m$^2$ after 300 h, cathode faradie efficiency % calculated on lead and stability/un-stability of the material under corrosion, are reported in Tables 2.1. and 2.2

TABLE 2.1

| | |
|---|---|
| $HBF_4$, tetrafluoroboric acid: | 150 g/l |
| lead ion: | 60 g/l |
| $H_3PO_4$, phosphoric acid: | 2 g/l |
| temperature: | Ambient |
| cathode: | Lead |
| anodic current density: | 1000 A/m$^2$ |

TABLE 2.2

| SAMPLES No. | Composition % Matrix | Additives | | | | RESULTS $O_2$ evolution PO V (NHE) initial | 300 h | Faradic efficiency % | REMARKS |
|---|---|---|---|---|---|---|---|---|---|
| | Ni—Cu 90-10 | $SnO_2$—$Sb_2O_3$ | | | | | | | |
| 1 | 95 | 5 | = | | | 6.8 | = | 100 | corroded |
| 2 | 95 | 4.90 | 0.10 | | | 2.5 | 2.6 | 100 | not corroded |
| 3 | 90 | 9.80 | 0.20 | | | 2.45 | 2.8 | 100 | not corroded |
| | Ni—Cu 80-20 | $SnO_2$—$Sb_2O_3$ | | | | | | | |
| 4 | 95 | 5 | = | | | 6.8 | = | 100 | corroded |
| 5 | 95 | 4.9 | 0.1 | | | 2.5 | 2.38 | 100 | not corroded |
| 6 | 90 | 9.8 | 0.2 | | | 2.45 | 2.38 | 100 | not corroded |
| | Ni—Cu 90-10 | $CeO_2$—$Ta_2O_5$—NiO—$Pr_6O_{11}$ | | | | | | | |
| 7 | 95 | 5 | = | = | = | 8.5 | = | 100 | corroded |
| 8 | 95 | 4.9 | 0.1 | = | = | 2.8 | 2.65 | 100 | not corroded |
| 9 | 95 | 4.8 | 0.1 | 0.1 | = | 2.9 | 2.6 | 100 | not corroded |
| 10 | 95 | 4.8 | 0.1 | 0.05 | 0.05 | 2.8 | 2.55 | 100 | not corroded |
| 11 | 90 | 9.6 | 0.2 | 0.1 | 0.1 | 2.7 | 2.3 | 100 | not corroded |
| | 80 20 | | | | | | | | |
| 12 | 90 | 9.6 | 0.2 | 0.1 | 0.1 | 2.8 | 2.40 | 100 | |

The results obtained on Ni-Cu alloys bring to the following conclusions:

Tin Dioxide corrosion on SnO2 without additives no visible corrosion under operation with $O_2$ evolution on $SnO_2$ added with $Sb_2O_3$ after 300 hours of operation.

Cerium Dioxide anodic corrosion on $CeO_2$ without additives no visible corrosion under operation with oxygen evolution after 300 hours of operation with $CeO_2$ containing additives increasing electrocatalytic activity according to the following order:

$$CeO_2 < CeO_2 + Ta_2O_5 < CeO_2 + Ta_2O_5 + NiO < CeO_2 + Ta_2O_5 + NiO + Pr_6O_{11}$$

Similar results may be obtained with Ni-Cu structures coated by an electrocatalytic coating, having the same composition as the particles used for the dispersion embedded in the matrix, said coating being applied by thermal decomposition of a paint containing suitable precursors. It is also to be pointed out that the addition of only 2 g/l of phosphoric acid ensures 100% cathodic Faradic efficiency: this means that no lead dioxide is formed at the anode.

EXAMPLE 3

Four rods, with a diameter of 20 mm, 100 mm long, made of nickel-copper alloy, have been obtained by casting the component metals together with powders based on tin oxide and/or cerium oxide (diameter 40–60 microns). Said samples have been tested as anodes for the electrolysis of fluoroboric solutions according to the conditions and procedures described in Example 2. The results are reported in Table 3.1.

TABLE 3.1

| SAMPLE No. | Composition % Matrix | Additives | | | | $O_2$ Evolution PO Volts (NHE) Init. | 300 h | Faradic Efficiency (%) |
|---|---|---|---|---|---|---|---|---|
| | Ni—Cu 90-10 | $SnO_2Sb_2O_3CuO$ | | | | | | |
| 1 | 95 | 4.8 | 0.15 | 0.05 | | 2.5 | 2.8 | 100 |
| 3 | 95 | 4.8 | 0.15 | 0.05 | | 2.5 | 2.38 | 100 |
| | Ni—Cu 80-20 | $CeO_2Ta_2O_5$ NiO $Pr_6O_{11}$ | | | | | | |
| 2 | 95 | 4.8 | 0.1 | 0.05 | 0.05 | 2.9 | 2.7 | 100 |
| 4 | 95 | 4.8 | 0.1 | 0.05 | 0.05 | 2.8 | 2.35 | 100 |

The samples reported in Table 3.1 showed also that metal structures made of $Cu_{20(10}$-$Ni_{80(90)}$ *after addition of* $SnO_2$ or $CeO_2$ containing additives do not undergo any visible corrosion when used as anodes for oxygen evolution.

EXAMPLE 4

Fifteen commercial tungsten rods with different contents of cobalt, nickel and iron have been used as anodes for oxygen evolution in the electrolysis of fluoroboric solutions as illustrated in Example 2. The results are reported Table 4.1

TABLE 4.1

| SAMPLES No. | Composition (%) W | Co | Ni | Fe | RESULTS $O_2$ Evolution PO VOLTS (NHE) Initial | 300 h | Faradic Efficiency % | REMARKS |
|---|---|---|---|---|---|---|---|---|
| 1 | 100 | | | | >6.00 | | | passivated |
| 2 | 90 | 10 | | | 2.6 | 2.4 | 100 | slight Co corroded |
| 3 | 80 | 20 | | | 2.3 | 2.3 | 100 | heavy Co leachng |
| 4 | 70 | 30 | | | 2.2 | 2.2 | 100 | heavy Co leaching |
| 5 | 65 | 35 | | | 2.2 | 2.2 | 100 | corroded |
| 6 | 95 | = | 5 | = | 3.2 | = | = | close to passivation |

TABLE 4.1-continued

| SAMPLES | | | | | RESULTS | | | |
|---|---|---|---|---|---|---|---|---|
| | Composition (%) | | | | $O_2$ Evolution PO VOLTS (NHE) | | Faradic Effi-ciency | RE- |
| No. | W | Co | Ni | Fe | Initial | 300 h | % | MARKS |
| 7 | 90 | = | 10 | = | 2.6 | 3.5 | = | close to passivation |
| 8 | 95 | = | = | 5 | 3.8 | = | = | close to passivation |
| 9 | 90 | = | = | 10 | 2.3 | 4.1 | = | close to passivation |
| 10 | 90 | 8 | 1 | 1 | 2.2 | 2.3 | 100 | not corroded |
| 11 | 80 | 15 | 2.5 | 2.5 | 2.1 | 2.2 | 100 | not corroded |
| 12 | 63 | 35 | 1 | 1 | 2.1 | 2.1 | 100 | not corroded |
| 13 | 60 | 38 | 1 | 1 | 2.1 | 2.1 | = | not corroded |
| 14 | 58 | 40 | 1 | 1 | 2.0 | 4.0 | = | corroded |
| 15 | 58 | 38 | 2 | 2 | 2.0 | 5.0 | = | passivated |

These results lead to the following conclusions:

tungsten is stable when used as anode in fluoroboric solutions (passivation)

elements like Co, Ni, Fe in minor amounts perform an electroatalytic activity for oxygen evolution the following series show an electrocatalytic activity increasing as per the following order: Fe<Ni<Co<-Co+Ni+Fe a critical concentration threshold for each additive or combination of the same has been found beyond which passivation or corrosion phenomena occur.

Similar results may be obtained by applying to the tungsten structure an electrocatalytic coating as described in Example 2.

EXAMPLE 5

Six rods having a diameter of 20 mm, 100 mm long, labelled as follows:

sample 1 as in Example 2, no. 6
sample 2 as in Example 2, no. 12
sample 3 as in Example 3, no. 3
sample 4 as in Example 3, no. 4
sample 5 as in Example 4, no. 4
sample 6 as in Example 4, no. 11 have been used as anodes for electrolysis of fluorosilic solutions containing lead ions and phosphoric acid.

The electrolysis conditions are reported in Table 5.1.

TABLE 5.1

| | |
|---|---|
| $H_2SiF_6$, fluorosilicic acid: | 100 g/l |
| $H_3PO_4$, phosphoric acid: | 6 g/l |
| lead ions: | 60 g/l |
| temperature: | ambient |
| anodic current density: | 1000 A/m$^2$ |
| cathode: | lead |

The results are reported in Table 5.2.

TABLE 5.2

| SAMPLES | RESULTS | | | |
|---|---|---|---|---|
| | $O_2$ Evolution PO Volts (NHE) | | Faradic Efficiency | |
| No. | Initial | 300 h | % | REMARKS |
| 1 | 2.45 | 2.38 | 100 | not corroded |
| 2 | 2.8 | 2.45 | 100 | not corroded |
| 3 | 2.5 | 2.38 | 100 | not corroded |
| 4 | 2.8 | 2.35 | 100 | not corroded |

TABLE 5.2-continued

| SAMPLES | RESULTS | | | |
|---|---|---|---|---|
| | $O_2$ Evolution PO Volts (NHE) | | Faradic Efficiency | |
| No. | Initial | 300 h | % | REMARKS |
| 5 | 2.2 | 2.22 | 100 | not corroded |
| 6 | 2.1 | 2.2 | 100 | not corroded |

EXAMPLE 6

Seven anodes having a passivatable metal matrix and a coating based on tungsten and cobalt were prepared; further four anodes were also tested as shown herebelow. The anodes, in the form of sheets, 100×10×1 mm, of commercial pure titanium, were sandblasted and samples 1 to 3 were further subjected to chemical pickling in boiling 20% HCl. All the samples were then coated by different kinds of coatings and tested at the same conditions illustrated in Example 2. The description of the anodes and the results of the tests are reported in Tables 6.1 and 6.2.

TABLE 6.1

| SAMPLE No. | Coating Composition % | Thickness (micron) | Load g/m$^2$ | Application Procedure |
|---|---|---|---|---|
| 1 | $RuO_2$ $TiO_2$ (50) (50) | 11.2 | 20 (Ru) | painting + thermal decomposition |
| 2 | $IrO_2$ $Ta_2O_5$ (50) (50) | 10.5 | 20 (Ir) | painting + thermal decomposition |
| 3 | Pt Sb (>98) (<2) | 2 | 21.5 (Pt) | galvanic deposition |
| 4 | beta $PbO_2$ | 800 | // | galvanic deposition |
| 5 | W | 155 | // | plasma jet |
| 6 | Co | 130 | // | plasma jet |
| 7 | Co | 140 | // | thermo spray |
| 8 | W + Co (97.5) (2.5) | 145 | // | plasma jet |
| 9 | W + Co (90) (10) | 135 | // | plasma jet |
| 10 | W + Co (80) (20) | 130 | // | plasma jet |
| 11 | W + Co (70) (30) | 130 | // | plasma jet |

TABLE 6.2

| SAMPLE | RESULTS | | | |
|---|---|---|---|---|
| | $O_2$ Evolution PO Volts (NHE) | | Faradic Efficien- | |
| No. | Initial | 300 h | cy % | REMARKS |
| 1 | 1.75 | // | // | corroded after 125 h |
| 2 | 1.80 | // | // | corroded after 140 h |
| 3 | 1.76 | 1.67 | 80 | corroded |
| 4 | 1.93 | 1.63 | 70 | corroded |
| 5 | >3.0 | // | // | passivated |
| 6 | 1.9 | 1.59 | 60 | Co leaching, corroded |
| 7 | 1.93 | 1.68 | 50 | complete Co leaching, corroded |
| 8 | 2.09 | 2.35 | 100 | slight Co leaching, incipient passivation |
| 9 | 2.05 | 2.08 | 100 | slight Co leaching incipient passivation |
| 10 | 2.00 | 1.75 | 60 | heavy Co leaching, corroded |
| 11 | 2.00 | 1.63 | 30 | heavy Co leaching, corroded |

Conventional coatings on titanium, such as noble metal oxides (e.g. $RuO_2$ and $IrO_2$) stabilized by valve metals, noble metals ((e.g. Pt) and lead dioxide (beta $PbO_2$) are mechanically ($PbO_2$) and/or chemically (Pt, $IrO_2$, $RuO_2$) unstable also after a few dozens of hours with the consequent corrosion of the substrate areas remained uncoated. The coatings based on tungsten passivated after a few minutes. The coatings based on cobalt corroded after a few hours while coatings based on tungsten-cobalt with cobalt contents around 10% show neither corrosion nor passivation. Lower cobalt contents do not prevent the passivating action of tungsten from prevailing with time while with higher cobalt contents dissolution is observed which causes mechanical unstability of the remaining coating.

EXAMPLE 7

Fifteen sheets, 10×10×1 mm, of commercial pure titanium, after sandblasting with corindone (pressure: 7 aim: distance of spraying pistol from substrate: 30–35 cm; abrasive grain: irregular shape, sharp edged, average diameter about 300 microns) were coated by plasma jet or thermospray technique with tungsten and cobalt coatings containing nickel, palladium and copper as doping elements. The samples thus obtained were used as anodes in the electrolysis of lead fiuoroborate solutions at the same conditions as illustrated in Example 2. The characteristics of the anodes are reported in Table 7.1 and the relevant results in Table 7.2.

TABLE 7.1

| SAMPLE No. | Matrix | COATING Composition % | Thickness microns | Application Procedure |
|---|---|---|---|---|
| 1 | Ti | W + Co (90) (10) | 140 | plasma spray |
| 2 | Ti | W + Co + Ni (89) (10.5) (0.5) | 145 | plasma spray |
| 3 | Ti | W + Co + Ni (89) (10) (1.0) | 145 | plasma spray |
| 4 | Ti | W + Co + Ni (89) (9.5) (1.5) | 135 | plasma spray |
| 5 | Ti | W + Co + Ni (88) (10) (2.0) | 130 | plasma spray |
| 6 | Ti | W + Co + Pd (89) (10.5) (0.5) | 100 | plasma spray |
| 7 | Ti | W + Co + Pd (89) (10) (1.0) | 110 | plasma spray |
| 8 | Ti | W + Co + Cu (88) (11.5) (0.5) | 105 | plasma spray |
| 9 | Ti | W + Co + Cu (89) (10.5) (0.5) | 115 | plasma spray |
| 10 | Ti | W + Co + Cu (89) (10) (1.0) | 125 | plasma spray |
| 11 | Ti | W + Co + Cu (90) (8.5) (1.5) | 125 | plasma spray |
| 12 | Ti | W + Co + Ni + Pd (89) (10) (0.5) (0.5) | 130 | plasma spray |
| 13 | Ti | W + Co + Ni + Pd (89) (10) (0.5) (0.5) | 130 | thermo spray |
| 14 | Ti | W + Co + Ni + Cu (89) (10) (0.5) (0.5) | 145 | plasma spray |
| 15 | Ti | W + Co + Ni + Cu (89) (10) (0.5) (0.5) | 120 | thermo spray |
| 16 | Ti | W + $CeO_2$ (97.5) (2.5) | 100 | plasma spray |
| 17 | Ti | W + $CeO_2$ + Co (92.5) (2.5) (5) | 110 | plasma spray |
| 18 | Ti | W + $CeO_2$ + Co (87.5) (2.5) (10) | 100 | plasma spray |

TABLE 7.2

| SAMPLE No. | RESULTS $O_2$ Evolution PO Volts (NHE) Initial | 300 h | Faradic Efficiency % | REMARKS |
|---|---|---|---|---|
| 1 | 2.04 | 2.17 | 100 | slight Co leaching |
| 2 | 2.05 | 2.19 | 100 | slight Co leaching |

TABLE 7.2-continued

| SAMPLE No. | RESULTS $O_2$ Evolution PO Volts (NHE) Initial | 300 h | Faradic Efficiency % | REMARKS |
|---|---|---|---|---|
| 3 | 2.04 | 2.08 | 100 | no corrosion |
| 4 | 2.04 | 2.09 | 100 | no corrosion |
| 5 | 2.02 | 2.18 | 100 | slight Co leaching |
| 6 | 2.09 | 2.06 | 100 | no corrosion |
| 7 | 2.07 | 2.10 | 100 | Pd traces in solution |
| 8 | 2.09 | 2.22 | 100 | no corrosion |
| 9 | 2.07 | 2.18 | 100 | no corrosion |
| 10 | 2.07 | 2.14 | 100 | no corrosion |
| 11 | 2.06 | 2.23 | 75 | Cu traces in solution |
| 12 | 2.06 | 2.09 | 100 | no corrosion |
| 13 | 2.07 | 2.07 | 100 | no corrosion |
| 14 | 2.05 | 2.10 | 100 | no corrosion |
| 15 | 2.08 | 2.08 | 100 | no corrosion |
| 16 | // | // | 100 | passivated |
| 17 | 2.11 | 2.15 | 100 | no corrosion |
| 18 | 2.05 | 2.10 | 100 | no corrosion |

The results permit to state that minimum quantitites of nickel, palladium, copper (1–1.5%) in a possible combination improve the chemical and electrochemical stability of the coatings. For each additive an optimum concentration has been determined in the range of 1–1.5% corresponding to the best performances. The presence of nickel, copper and palladium in the above concentrations avoids or, in any case, remarkably reduces the anodic leaching of cobalt. The combined presence of the above elements, for example Ni+Pd or Ni+Cu to an amount of 1–15% stabilizes the operating potential. This effect is particularly enhanced when the coating is applied by thermospray.

EXAMPLE 8

Seventeen sheets made of commercial titanium and titanium alloys (100×10×1 mm) were prepared according to the procedures described in Example 7 and coated by plasma or thermospray technologies with deposits based on W+Co, W+Co+Ni, W+Co+Ni+Pd, W+Co+Ni+Cu. The samples were tested as anodes in the electrolysis conditions described in Example 2 but with a double anodic current density (2000 $A/m^2$). The characteristics of the samples are reported in Table 8.1 while the results are reported in Table 8.2.

TABLE 8.1

| SAMPLE No. | Matrix | COATING Composition % | Thickness microns | Application Procedure |
|---|---|---|---|---|
| 1 | Ti | W + Co (90) (10) | 120 | plasma |
| 2 | Ti | W + Co + Ni (89) (10) (1) | 140 | plasma |
| 3 | Ti | W + Co + Ni + Pd (89) (10) (0.5) (0.5) | 135 | plasma |
| 4 | Ti | W + Co + Ni + Cu (89) (10) (0.5) (0.5) | 135 | plasma |
| 5 | Ti | W + Co + Ni + Pd (89) (10) (0.5) (0.5) | 120 | thermo-spray |
| 6 | TiPd | W + Co (90) (10) | 110 | plasma |
| 7 | TiPd | W + Co + Ni (89) (10) (1) | 105 | plasma |
| 8 | TiPd | W + Co + Ni + Pd (89) (10) (0.5) (0.5) | 110 | plasma |
| 9 | TiPd | W + Co + Cu + Pd (89) (10) (0.5) (0.5) | 115 | thermo-spray |
| 10 | TiNi | W + Co (90) (10) | 120 | plasma |

TABLE 8.1-continued

| SAMPLE No. | Matrix | COATING Composition % | Thickness microns | Application Procedure |
|---|---|---|---|---|
| 11 | TiNi | W + Co + Ni (89) (10) (1) | 105 | plasma |
| 12 | TiNi | W + Co + Ni + Pd (89) (10) (0.5) (0.5) | 115 | plasma |
| 13 | TiNi | W + Co + Ni + Pd (89) (10) (0.5) (0.5) | 115 | thermo-spray |
| 14 | Ti—Y | W + Co (90) (10) | 120 | plasma |
| 15 | Ti—Y | W + Co + Ni (89) (10) (1) | 125 | plasma |
| 16 | Ti—Y | W + Co + Ni + Pd (89) (10) (0.5) (0.5) | 130 | plasma |
| 17 | Ti—Y | W + Co + Ni + Pd (89) (10) (0.5) (0.5) | 130 | thermo-spray |

TABLE 8.2

| SAMPLE No. | RESULTS $O_2$ Evolution PO Volts (NHE) Initial | 300 h | Faradic Efficiency % | REMARKS |
|---|---|---|---|---|
| 1 | 2.14 | 1.93 | 100 | Co leaching, corroded |
| 2 | 2.18 | 2.05 | 100 | slight Co leaching, corroded |
| 3 | 2.19 | 2.05 | 100 | corroded |
| 4 | 2.19 | 2.08 | 100 | corroded |
| 5 | 2.15 | 2.10 | 100 | corroded |
| 6 | 2.18 | 2.13 | 100 | not corroded |
| 7 | 2.18 | 2.13 | 100 | not corroded |
| 8 | 2.18 | 2.13 | 100 | not corroded |
| 9 | 2.18 | 2.15 | 100 | not corroded |
| 10 | 2.19 | 2.15 | 100 | not corroded |
| 11 | 2.17 | 2.15 | 100 | not corroded |
| 12 | 2.17 | 2.15 | 100 | not corroded |
| 13 | 2.17 | 2.16 | 100 | not corroded |
| 14 | 2.20 | 2.01 | 100 | Co leaching, corroded |
| 15 | 2.22 | 2.02 | 100 | Co leaching, corroded |
| 16 | 2.18 | 2.08 | 100 | Co leaching, corroded |
| 17 | 2.19 | 2.01 | 100 | Co leaching, corroded |

The results obtained at 2000 A/m$^2$ led to the following considerations:

titanium structures, accidentally contacting the electrolyte due to chemical or mechanical removal of the coating, undergo a remarkable corrosion; this negative behavior is less important with ternary or quaternary deposits, for these latter especially when obtained by thermo-spray, being more compact;

titanium-yttrium ( Y 0.35% ) samples show a similar behavior compared with samples of commercial titanium, with the same coating;

titanium-palladium ( Pd 0.20%) and titanium nickel (Ni 1.5%) samples show a higher stability. Corrosion is lower as it can be seen from the anodic potential values which are stable with time: in fact an increasing potential is a symptom of passivation of the coating, while a decreasing potential shows of the corrosion of the substrate.

EXAMPLE 9

Five sheets (100×10×1 mm) made of titanium, tantalum, niobium, tungsten and of a nickel (90%)-copper (10%) alloy, after a surface treatment as described in Example 7, have been coated by a coating of W (89)+Co(10)+Ni(0.5)+Pd(0.5) applied by plasma jet. The samples have been tested as anodes in the eleetrolysis of lead fluoroborates solutions at the same conditions as illustrated in Example 8. The results are reported in Table 9. The cathodic deposition efficiency of lead was 100%.

TABLE 9

| SAMPLES No. | Matrix Composition % | RESULTS Coating Thickness micron | $O_2$ Evolution PO Volts (NHE) Initial | 500 h | REMARKS |
|---|---|---|---|---|---|
| 1 | Ti | 140 | 2.20 | 2.06 | corroded |
| 2 | Ta | 135 | 2.17 | 2.17 | no corrosion |
| 3 | Nb | 145 | 2.21 | 2.17 | slightly corroded |
| 4 | W | 125 | 2.18 | 2.18 | no corrosion |
| 5 | Ni(90) + Cu(10) | 130 | 2.20 | 2.20 | no corrosion |

The results lead to the following considerations:

when the substrate is made of tantalum, tungsten or Ni(90)- Cu(10) alloy, a good stability and constant anodic potentials of the coatings applied to the same are experienced;

the substrate made of titanium is unstable and the anodic potential of the coating rapidly decreases with time;

an intermediate situation is experienced with the substrate made of niobium with anodic potentials slightly decreasing with time.

We claim:

1. In a process for the electrocatalytic recovery of metals from aqueous solutions containing metal ions and fluoride ions or anionic fluorocomplexes, wherein the improvement comprises using as the anode a) a passivatable metal matrix comprising a nickel-copper alloy containing 5 to 20% by weight of copper, b) an electrocatalytic compound for oxygen evolution and c) at least one other additive.

2. The process of claim 1 wherein the metal ions are lead.

3. The process of claim 1 wherein said electrocatalytic compound is present in said metal matrix as an alloy or as a dispersion.

4. The process of claim 1 wherein the electrocatalytic compound is in the form of a coating on said metal matrix.

5. The process of claim 1 wherein the electrocatalytic compound is selected from the group consisting of cobalt, cerium dioxide and tin oxide.

6. The process of claim 5 wherein the electrocatalytic compound comprises cobalt and the additive is at least one element selected from the group consisting of nickel, copper, iron, palladium and cerium.

7. The process of claim 5 wherein the electrocatalytic compound is cerium dioxide and the additive is at least one member selected from the group consisting of niobium oxide, nickel oxide, praseodymium oxide and copper oxide.

8. The process of claim 5 wherein the electrocatalytic compound is tin oxide and the additive is at least one oxide selected from the group consisting of antimony oxide and copper oxide.

* * * * *